US006474033B1

(12) United States Patent
Luchini et al.

(10) Patent No.: US 6,474,033 B1
(45) Date of Patent: Nov. 5, 2002

(54) PREFABRICATED FINISHING MODULE FOR THE CONSTRUCTION OF BUILDING CONSTRUCTIONS AND BUILDING CONSTRUCTIONS OBTAINED THEREBY

(75) Inventors: Claudio Luchini, Aosta (IT); Giulio Vallacqua, Aosta (IT)

(73) Assignees: Studio Arch. Claudio Luchini, Aosta (IT); Studio3GV - Progetti - Giulio, Aosta (IT); Vallacqua Ingegnere-Giacomo, Aosta (IT); Galvami Architto S.S., Aosta (IT)

( * ) Notice: Subject to any disclaimer, the term of this patent is extended or adjusted under 35 U.S.C. 154(b) by 0 days.

(21) Appl. No.: 09/717,479

(22) Filed: Nov. 20, 2000

Related U.S. Application Data

(63) Continuation of application No. PCT/IT99/00140, filed on May 19, 1999.

(30) Foreign Application Priority Data

May 19, 1998 (IT) ..... TO98A0424

(51) Int. Cl.[7] ..... E04B 2/00

(52) U.S. Cl. ..... 52/426; 52/275; 72/44; 249/40

(58) Field of Search ..... 52/426, 562, 564, 52/565

(56) References Cited

U.S. PATENT DOCUMENTS 2,676,482 A * 4/1954 Wilson ..... 72/44
6,231,025 B1 * 5/2001 Takemura ..... 249/40
6,250,033 B1 * 6/2001 Zelinsky ..... 52/275

FOREIGN PATENT DOCUMENTS

| | | |
|---|---|---|
| EP | 0 118 374 | 9/1984 |
| EP | 0 692 585 A | 3/1996 |
| GB | 1 429 524 A | 3/1976 |

OTHER PUBLICATIONS

Courtesy copy of the PCT International Preliminary Examination report in 5 pages, dated Sep. 1, 2000.
Courtesy copy of the PCT International Search Report in 3 pages, dated Sep. 9, 1999.

* cited by examiner

*Primary Examiner*—Carl D. Friedman
*Assistant Examiner*—Steve Varner
(74) *Attorney, Agent, or Firm*—Knobbe Martens Olson & Bear LLP

(57) ABSTRACT

A prefabricated finishing module for the construction of building constructions provided with at least one pair of panels facing one another, bounding a space for the casting of concrete, adapted to be connected to one another and to respective panels of adjacent modules and each bounded by first edges opposite one another and by second edges opposite one another and extending between respective ends of the first edges. The module is characterized in that the first edges of each panel have respective first longitudinal grooves aligned with one another and in that the second edges have respective second longitudinal grooves aligned with one another, intersecting the first grooves and transversely offset with respect to first grooves; the first and second grooves are engaged in use, at least in part, by respective first and second anchors adapted to connect the module to adjacent modules intersecting one another reciprocally.

28 Claims, 5 Drawing Sheets

PREFABRICATED FINISHING MODULE FOR THE CONSTRUCTION OF BUILDING CONSTRUCTIONS AND BUILDING CONSTRUCTIONS OBTAINED THEREBY

RELATED APPLICATIONS

This application is a continuation of PCT Application PCT/IT99/00140, filed on May 19, 1999.

TECHNICAL FIELD

The present invention relates to prefabricated finishing modules for the construction of building constructions in concrete and to the building constructions obtained thereby.

BACKGROUND ART

It is known to produce walls or other building constructions in concrete by means of formworks substantially configured as "boxes" and formed by a plurality of wooden or metal panels, disposed in contact with one another and bounding between one another cavities whose shape may vary in complexity and within which the concrete is cast. In order to prevent, during casting, the thrust of the fresh concrete from causing the panels to move apart and the formworks to open, these panels are generally connected together by transverse tie rods which project externally from the formworks.

This method of building construction requires the operational insertion of any reinforcing rods into the cavities of the formworks before the concrete is cast, and the subsequent removal of these formworks once the casting has hardened.

"Disposable" formworks are also known that do not cooperate statically with the concrete structure and which are formed from various materials, for instance board, wood chip agglomerate, plastic materials, etc. These formworks are generally held in position prior to casting by fixed uprights, spacers with fastening wedges or steel yokes; these positioning means generally require relatively long assembly times and also have the drawback that they project partially from the exterior of the formworks.

In this case, the formwork removal operation is therefore avoided, but once the concrete mixture has reached an appropriate consistency, it is necessary to cut or bend the projecting portions of these positioning means in order to facilitate the application of the plaster.

SUMMARY OF INVENTION

The present invention which relates to a prefabricated finishing module for the construction of building constructions formed by a plurality of such modules adjacent to one another, the module comprising at least one pair of panels facing one another, bounding a space for the casting of concrete, and adapted to be connected to one another and to respective panels of adjacent modules by relative connecting means, each such panel being bounded by first lateral ribs opposite one another and by second lateral ribs opposite one another and extending between respective ends of the first ribs, characterised in that these first ribs of each panel have respective first longitudinal grooves aligned with one another and in that the second ribs have respective second longitudinal grooves aligned with one another, intersecting the first grooves and transversely offset with respect to these first grooves, the first and second grooves of the panels being engaged in use, at least in part, by respective first and second anchoring members adapted to connect the module to adjacent modules, intersecting one another reciprocally and defining the connecting means.

BRIEF DESCRIPTION OF THE DRAWINGS

A preferred embodiment of the present invention is described in detail below, purely by way of non-limiting example, with reference to the accompanying drawings, in which.

DETAILED DESCRIPTION OF THE INVENTION

Figure 1:
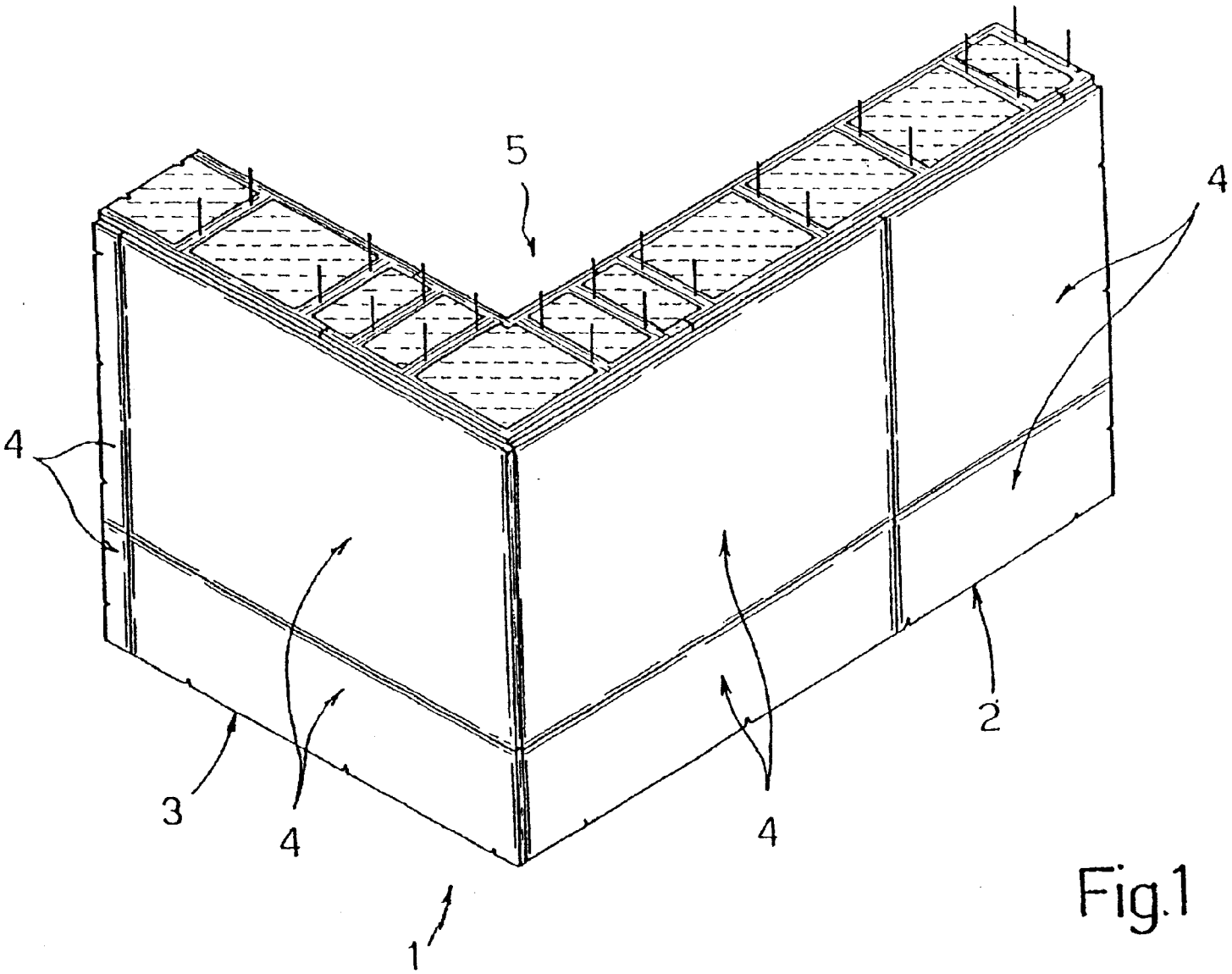
FIG. 1 is a perspective view, partially in section, of a building construction comprising a plurality of prefabricated finishing modules of the present invention.

In FIG. 1, a non-limiting embodiment of a prefabricated building construction of the present invention is shown overall by 1, and is in this case a wall formed by a pair of plane panels 2, 3 disposed at right angles, to which the following description will refer without, however, entering into general details.

The building construction 1 essentially comprises a plurality of prefabricated finishing modules 4 adjacent to one another and connecting means 5 for these modules The modules 4 can also be used to construct building constructions of different type, for instance support bases, caissons, boxes, architraves, floors, dividing walls, road building works, urban furniture, etc.

With reference to FIGS. 2 and 5 to 8, each module 4 comprises a pair of panels 7 of rectangular profile that face one another, bound a space 8 for the casting of concrete and are connected together by the above-mentioned connecting means 5; each panel 7 is bounded by first horizontal edges 9 opposite one another and by second vertical edges 10 opposite one another, of smaller length than the edges 9 and extending between respective ends of these edges 9.

In the embodiment shown, the panels 7 are made from concrete, of normal or of lightweight or lightweight-insulating type, and the space 8 is adapted to be filled with concrete, also of normal or of lightweight or lightweight-insulating type.

Each panel 7 is further bounded towards the exterior of the building construction 1 by a rectangular surface 11, whose finishing quality may be factory produced prior to the installation of the module 4; the surface 11 may, in particular, be left untreated or may be provided with relief decorations or covered with grit, stone, marble, etc.

Figure 5:
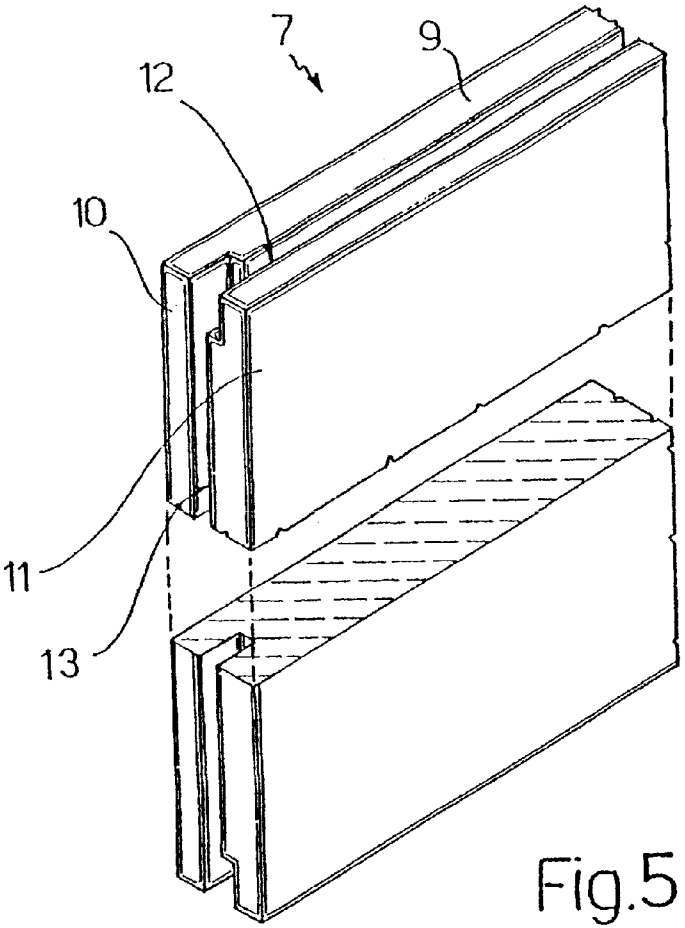
FIG. 5 is a perspective view, on an enlarged scale, of a panel of a relative module of the building construction of FIG. 1 in partial section.
Figure 7:
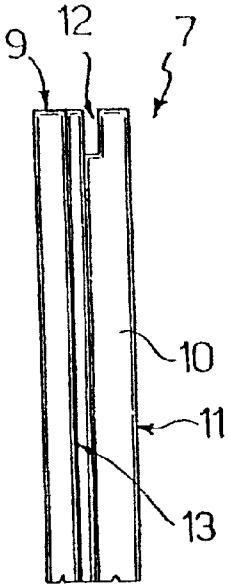
FIG. 7 is a side view of the panel of FIG. 5.
Figure 6:
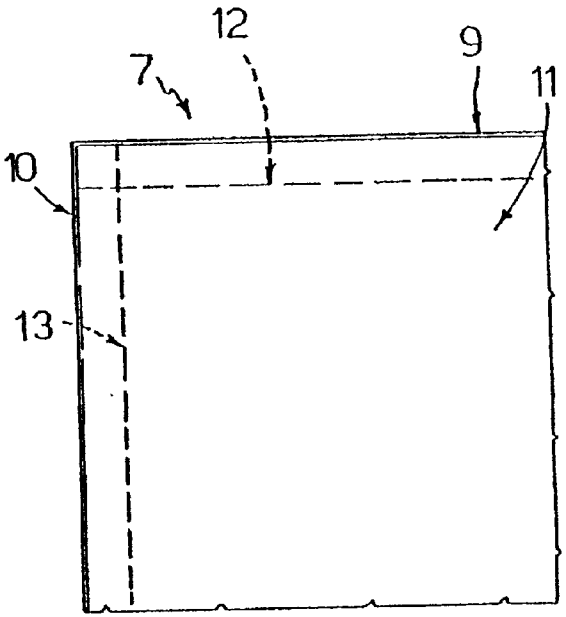
FIG. 6 is a front view of the panel of FIG. 5.
Figure 8:
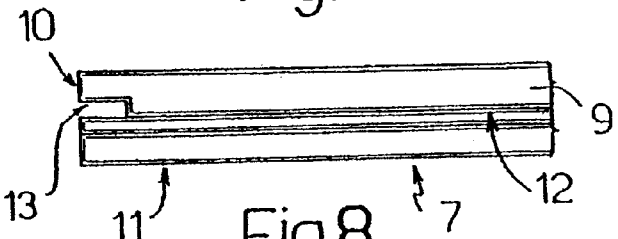
FIG. 8 is a plan view of the panel of FIG. 5.

According to the present invention, the edges 9 of the panels 7 of each module 4 have respective longitudinal grooves 12 aligned with one another and the edges 10 of the panels 7 of each module 4 have respective longitudinal grooves 13 aligned with one another and transversely offset with respect thereto. As best shown in FIG. 5, the grooves 12, 13 present respective end portions, each shaped so as to intersect the adjacent one. In particular, the end portions of each groove 12, 13 have enlarged cross sections with respect to the main portion of the said groove 12, 13.

The connecting means 5 comprise first anchoring members 15 of metal material engaging in a concealed way with the grooves 12 of relative panels 7 of adjacent modules 4 and second anchoring members 16, also of metal material, engaging in a concealed way with the grooves 13 of relative panels 7 of adjacent modules 4 and transversely intersecting the respective anchoring members 15.

Figure 2:
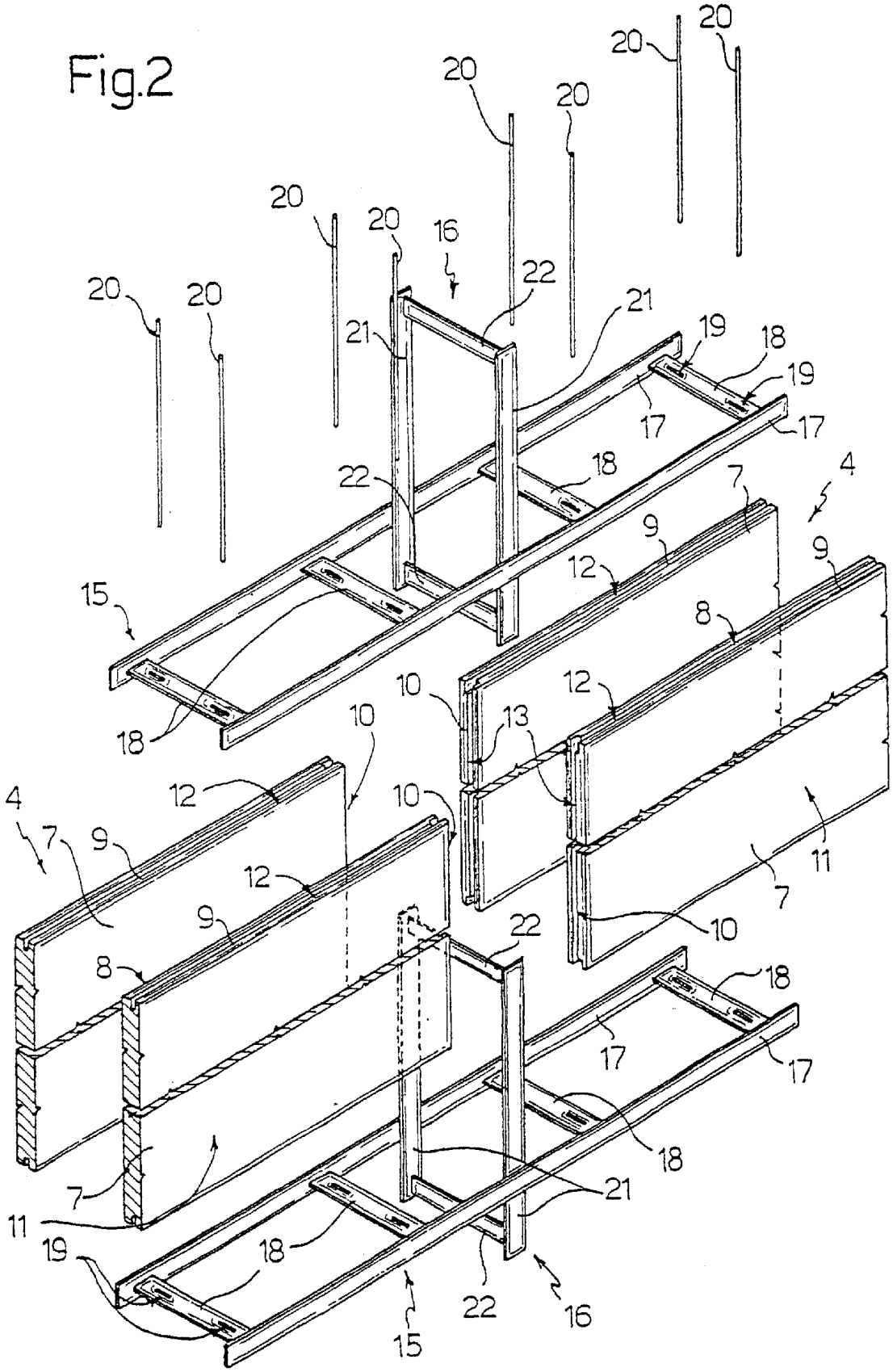
FIG. 2 is a perspective view, on an enlarged scale, of an assembly layout of two modules of the building construction of FIG. 1 for the formation of a plane wall.

With particular reference to FIG. 2, each anchoring member 15 comprises a pair of rectilinear and parallel bars 17 each engaging relative halves of grooves 12 of adjacent panels 7 of adjacent modules 4, and a plurality of crossbars 18 of flat shape, four of which are shown in the drawing, extending at right angles between the bars 17 and each having a pair of substantially rectangular through openings 19 adapted to be engaged, in use, by respective vertical reinforcing bars 20.

Similarly, each anchoring member 16 comprises a pair of rectilinear and parallel bars 21 each engaging relative halves of grooves 13 of adjacent panels 7 of adjacent modules 4, and a plurality of crossbars 22 of flat shape, two of which are shown in the drawing, extending at right angles bet ween these bars 21.

As can be seen from FIG. 2, the formation of each of the walls 2, 3 is carried out by horizontally closing up and vertically stacking the modules 4 on one another by manual movement and connecting them together by the anchoring members 15 and 16.

The first operation consists in particular in disposing a plurality of anchoring members 15 on the support plane of the wall 2, 3 in alignment with one another. A first horizontal row of nodules 4 is then mounted by disposing the lower grooves 12 of the panels 7 in engagement in the relative bars 17 of the anchoring members 15; in this way, the panels 7 have their respective outer surfaces 11 in alignment. The grooves 13 of each pair of panels 7 in contact with one another are, however, engaged along half their length by a relative anchoring member 16 which is therefore disposed at right angles to the relative anchoring member 15 and another half of which projects vertically with respect to these panels 7.

At this point, a plurality of anchoring members 15, which are positioned with their bars 17 engaged in the relative upper grooves 12 of the panels 7 forming the modules 4 and intersect the anchoring members 16, is disposed on the first row of modules 4. The wall 2, 3 is then completed by the successive assembly of other horizontal rows of modules 4 connected to one another by respective first and second anchoring members 15 and 16.

Preferably, but not necessarily, before casting of the concrete, the openings 19 of the crossbars 18 of the anchoring members 15 disposed in alignment with one another in the vertical direction are engaged by respective longitudinal reinforcing bars 20 (FIGS. 1 and 2).

Figure 3:
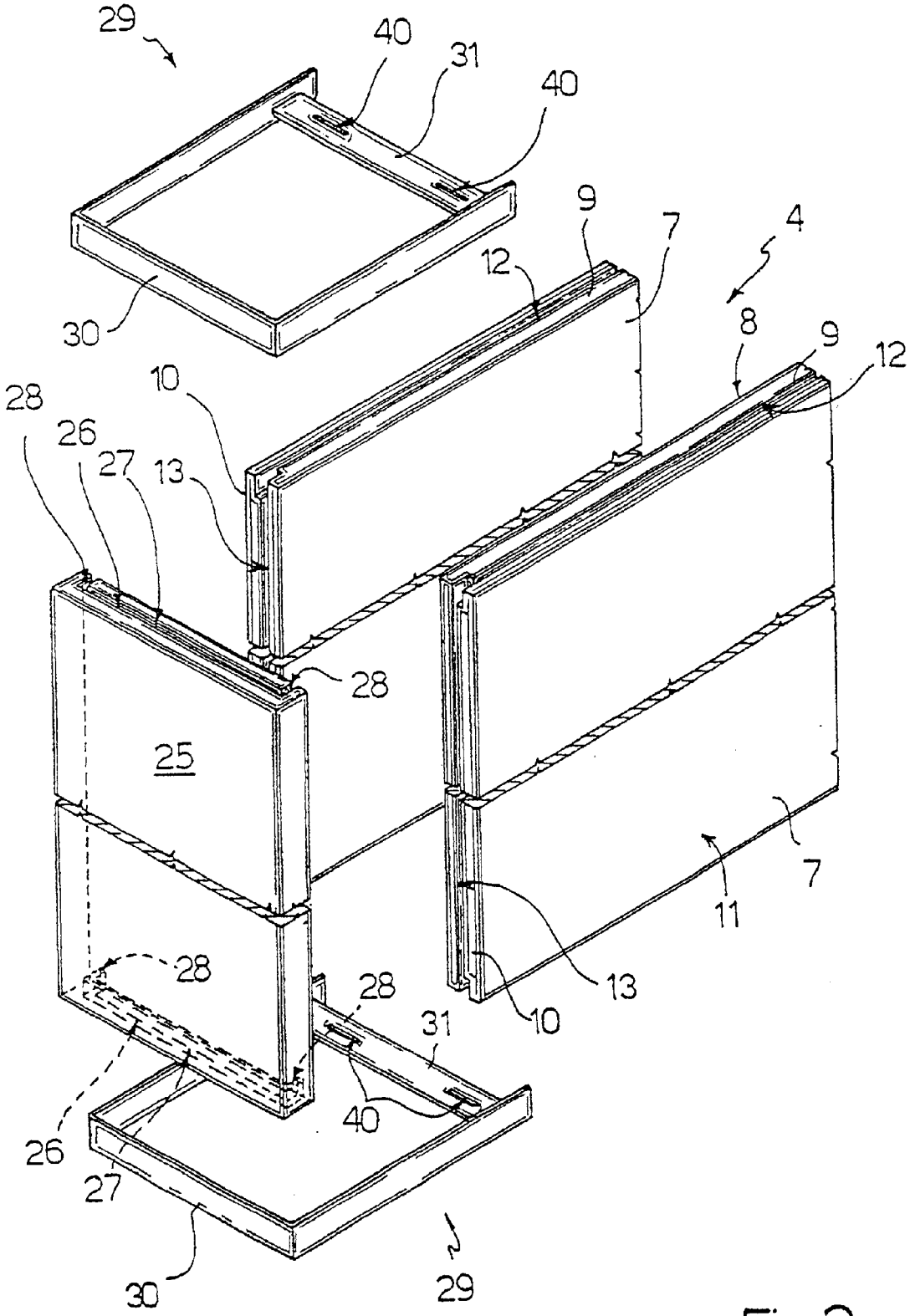
FIG. 3 is a perspective view, on an enlarged scale, of an end module of the building construction of FIG. 1.

As shown in detail in FIG. 3, the modules 4, adapted in use to form the lateral ends of the walls 2, 3 are closed laterally by respective heads 25 which are formed by plane members adapted to be disposed in abutment against the edges 10 of the relative panels 7. In particular, the heads 25 are provided, at the location of their lower and upper edges; with respective C-shaped grooves 26 communicating at opposite ends with the grooves 12 of the relative panels 7 and disposed in the same plane as the latter. In more detail, each groove 26 comprises a main rectilinear portion 27 extending longitudinally over the entire length of the relative rib and two end sections 28 perpendicular to the main portion 27 and open laterally towards the relative panels 7.

Each head 25 is connected to the relative panels 7 by a pair of third anchoring members 29 of metal material comprising a C-shaped bar 30 and a crossbar 31 extending between relative free end portions of the bar 30 and having a pair of substantially rectangular through openings 40 adapted to be engaged by longitudinal reinforcing bars 20; in use, the bar 30 of each anchoring member 29 is disposed in engagement in the relative groove 26 of the head 25 and in relative halves of the grooves 12 of the corresponding panels 7.

Figure 4:
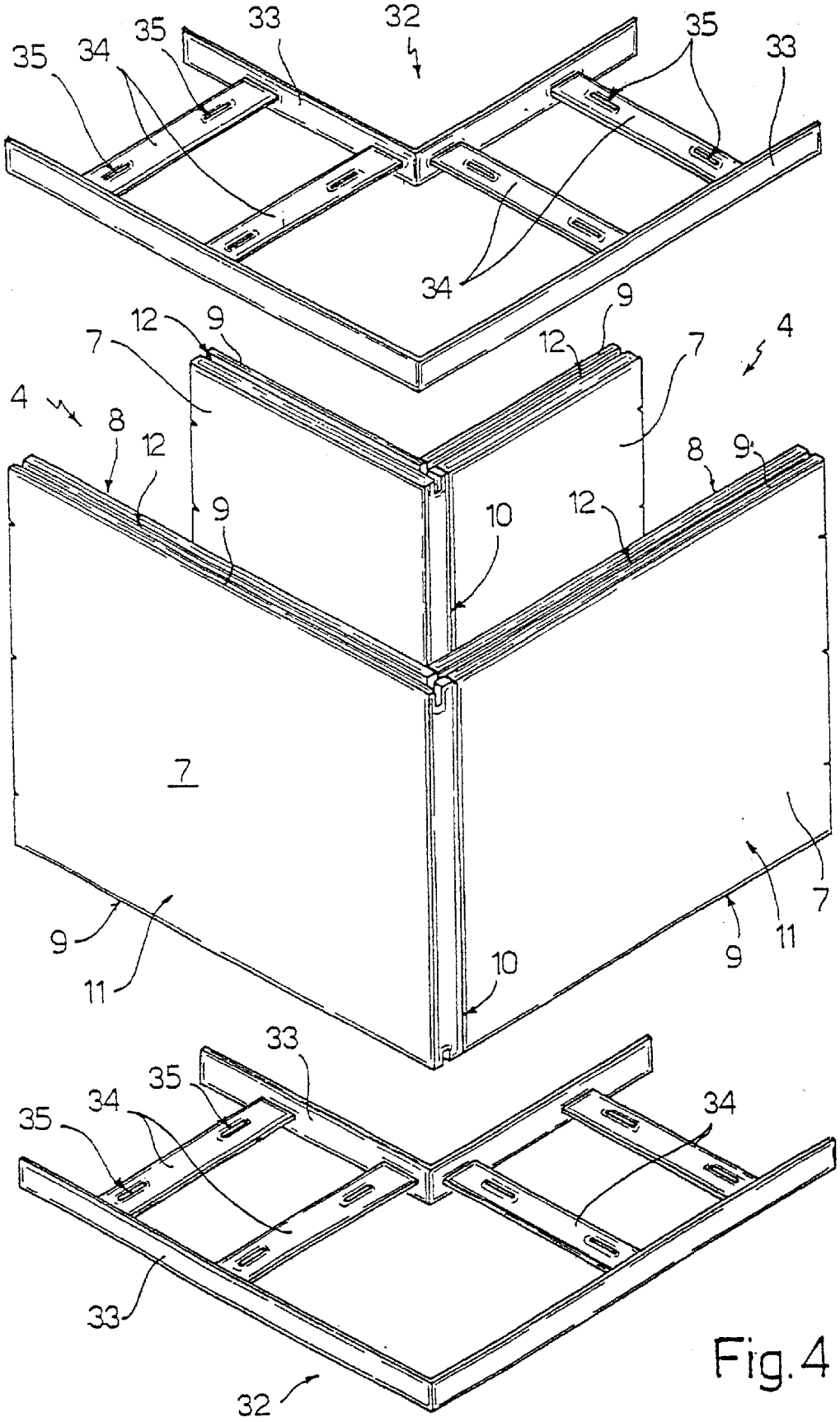
FIG. 4 is a perspective view, on an enlarged scale, of an assembly layout of two modules of the building construction of FIG. 1 for the formation of a corner.

With particular reference to FIG. 4, the formation of the corner between the walls 2 and 3 is carried out by disposing the panels 7 of the relative modules 4 in abutment with one another at the location of their respective lateral ends; in more detail, one of the panels 7 forming the corner is disposed in abutment, at the location of one of its edges 10, against a relative plane surface of the other panel 7 that, in use, faces the interior of the building construction 1, such that these panels 7 have their relative lower and upper grooves 12 disposed at right angles and communicating with one another.

The panels 7 of each pair of modules 4 disposed to form the corner are connected by a pair of fourth anchoring members 32 of metal material comprising a pair of parallel L-shaped bars 33 and a plurality of crossbars 34 of flat shape, four of which are shown in the drawing, two on each side of the bars 33, extending between these bars 33 and each having a pair of substantially rectangular through openings 35 adapted to be engaged by relative longitudinal reinforcing bars 20. In use, each anchoring member 32 is disposed with its bars 33 in engagement in relative halves of the grooves 12 of the adjacent panels 7 forming the corner.

The advantages offered by the present invention are evident from an examination of the characteristic features of the building construction 1 and its relative modules 4.

In particular, the use of the modules 4 makes it possible to construct, in a highly flexible way, building constructions formed by a sequence of adjacent units connected to one another in a way that is invisible from outside. The module 4 does not just act as a formwork to contain the casting, but also cooperates statically with the completed casting during installation, forming part of the final building construction.

As a result of the presence of the grooves 12, 13 and the simplicity of the configuration of the anchoring members 15, 16, 29, 32, the assembly of the modules 4 is carried out by successive fittings and is therefore particularly easy and rapid and does not, in particular, require any operation to remove the connecting means once the casting has reached an appropriate consistency.

Moreover, because of their relatively small dimensions, the panels 7 do not require specialist assemblers or powerful lifting means but can, in contrast, be moved and positioned in a completely manual way.

Lastly, because fewer site operations need to be performed, the majority of quality controls can be carried out in the factories producing the modules 4, with substantial financial advantages.

It is evident that the modules 4 and the building construction 1 described above can be modified and varied without thereby departing from the scope of protection of the present invention.

The modules 4 could in particular be covered by or made from other types of material, for instance plastic, metal, wood-based, brick, stone or marble materials and insulating materials.

As an alternative, the anchoring members 15, 16, 29, 32 could, moreover, be produced from rigid plastic material.

Moreover, each module 4 could include three or more panels 7, which are positioned parallel to each other and are connected together by anchoring members similar to anchoring members 15, 16. By this means, two of the panels 7 of each module 4 define a wall of the building constriction, and the other panels 7 delimit with said wall a gap facing towards the interior or the exterior of the building construction.

What is claimed is:

1. A prefabricated finishing module comprising:

at least one pair of panels facing one another, each such panel being bounded by first horizontal edges opposite one another and by second vertical edges opposite one another and extending between respective ends of the first edges; wherein said first edges of each panel have respective first longitudinal grooves aligned with one another and said second edges have respective second longitudinal grooves aligned with one another and transversely offset with respect to the first grooves, said first and second grooves presenting respective end portions shaped so as to intersect the adjacent grooves; and first and second anchors, wherein said first and second anchors at least partially engage said first and second grooves, and intersect one another reciprocally for connecting the module to adjacent modules, wherein said first and second anchors to extend beyond each other a substantial amount of the length of said joined panels from the corners where joined panels meet.

2. The module of claim 1, wherein said panels are made at least in part from concrete.

3. The module of claim 1, wherein said panels are made at least in part from brick.

4. The module of claim 1, wherein the panels are made at least in part from plastic material.

5. The module of claim 1, wherein said panels are made at least in part from metal material.

6. The module of claim 1, wherein said panels are made at least in part from wood-based material.

7. The module of claim 1, wherein said panels are made at least in part from stone.

8. The module of claim 1, wherein said panels are made at least in part from marble.

9. The module of claim 1, wherein said panels are made at least in part from insulating material.

10. A building construction comprising a plurality of prefabricated finishing modules as defined in claim 1.

11. The building construction of claim 10, wherein said first anchor comprises a pair of parallel first bars each engaging at least part of the first grooves of adjacent panels of adjacent modules and a plurality of first crossbars extending at right angles between said first bars; and wherein said second anchor comprises a pair of parallel second bars each engaging at least part of the second grooves of adjacent panels of adjacent modules and a plurality of second crossbars extending at right angles between said second bars.

12. The building construction of claim 11, wherein said first crossbars of the first anchor comprise at least one opening adapted to receive at least one reinforcing bar.

13. The building construction of claim 12, wherein at least one of the modules is closed on at least one side by a head disposed in abutment against the panels and having a pair of C-shaped grooves communicating at their ends with respective first grooves of said panels, additionally comprising a third anchor adapted to connect the head to the panels and comprising a C-shaped bar engaging with at least part of the first groove and at least one of said pair of C-shaped grooves.

14. The building construction of claim 13, wherein at least one of the panels are joined at right angles and wherein the anchors comprise a pair of parallel L shaped bars.

15. The building construction of claim 11, wherein said first crossbars of said first anchor comprise two openings adapted to receive reinforcing bars.

16. The building construction of claim 11, wherein at least one of the modules is closed on at least one side by a head disposed in abutment against the panels and having a pair of C-shaped grooves communicating at their ends with respective first grooves of said panels, additionally comprising a third anchor adapted to connect the head to the panels and comprising a C-shaped bar engaging with at least part of the first groove and at least one of said pair of C-shaped grooves.

17. The building construction of claim 16, wherein said third anchor comprises a crossbar extending between the free end portions of said C-shaped bar.

18. The building construction of claim 10, wherein at least one of the panels are joined at right angles and wherein the anchors comprise a pair of parallel L shaped bars.

19. The building construction of claim 10, wherein said anchors are made from metal material.

20. The building construction of claim 10, wherein said anchors are made from rigid plastic material.

21. A prefabricated finishing module comprising:

at least one pair of panels facing one another, each such panel being bounded by first edges opposite one another and by second edges opposite one another and extending between respective ends of the first edges; wherein said first edges of each panel have respective first longitudinal grooves aligned with one another and said second edges have respective second longitudinal grooves aligned with one another and transversely offset with respect to the first grooves, said first and second grooves presenting respective end portions shaped so as to intersect the adjacent grooves; and first and second anchors, wherein said first and second anchors at least partially engage said first and second grooves, and intersect one another reciprocally for connecting the module to adjacent modules, wherein at least one of the modules is closed on at least one side by a head disposed in abutment against the panels and having a pair of C-shaped grooves communicating at their ends with respective first grooves of said panels, additionally comprising a third anchor adapted to connect the head to the panels and comprising a C-shaped bar engaging with at least part of the first groove and at least one of said pair of C-shaped grooves.

22. The module of claim 21, wherein said third anchor comprises a crossbar extending between the free end portions of said C-shaped bar.

23. A prefabricated finishing module comprising:

at least one pair of panels facing one another, each such panel being bounded by first edges opposite one another and by second edges opposite one another and extending between respective ends of the first edges; wherein said first edges of each panel have respective first longitudinal grooves aligned with one another and said second edges have respective second longitudinal grooves aligned with one another and transversely offset with respect to the first grooves, said first and second grooves presenting respective end portions shaped so as to intersect the adjacent grooves;

first and second anchors, wherein said first and second anchors at least partially engage said first and second grooves, and intersect one another reciprocally for connecting the module to adjacent modules, at least one pair of panels joined at right angles and additionally comprising a third anchor comprising a pair of parallel L shaped bars.

24. A building construction comprising a plurality of prefabricated finishing modules, said finishing modules comprising:

at least one pair of panels facing one another, each such panel being bounded by first edges opposite one another and by second edges opposite one another and extending between respective ends of the first edges; wherein said first edges of each panel have respective first longitudinal grooves aligned with one another and said second edges have respective second longitudinal grooves aligned with one another and transversely offset with respect to the first grooves, said first and second grooves presenting respective end portions shaped so as to intersect the adjacent grooves; and first and second anchors, wherein said first and second anchors at least partially engage said first and second grooves, and intersect one another reciprocally for connecting the module to adjacent modules, wherein said first anchor comprises a pair of parallel first bars each engaging at least part of the first grooves of adjacent panels of adjacent modules and a plurality of first crossbars extending at right angles between said first bars; and wherein said second anchor comprises a pair of parallel second bars each engaging at least part of the second grooves of adjacent panels of adjacent modules and a plurality of second crossbars extending at right angles between said second bars; and wherein at least one of the modules is closed on at least one side by a head disposed in abutment against the panels and having a pair of C-shaped grooves communicating at their ends with respective first grooves of said panels, additionally comprising a third anchor adapted to connect the head to the panels and comprising a C-shaped bar engaging with at least part of the first groove and at least one of said pair of C-shaped grooves.

25. The building construction of claim 24, wherein said third anchor comprises a crossbar extending between the free end portions of said C-shaped bar.

26. A building construction comprising a plurality of prefabricated finishing modules, said finishing modules comprising:

at least one pair of panels facing one another, each such panel being bounded by first edges opposite one another and by second edges opposite one another and extending between respective ends of the first edges; wherein said first edges of each panel have respective first longitudinal grooves aligned with one another and said second edges have respective second longitudinal grooves aligned with one another and transversely offset with respect to the first grooves, said first and second grooves presenting respective end portions shaped so as to intersect the adjacent grooves; and first and second anchors, wherein said first and second anchors at least partially engage said first and second grooves, and intersect one another reciprocally for connecting the module to adjacent modules, wherein said first anchor comprises a pair of parallel first bars each engaging at least part of the first grooves of adjacent panels of adjacent modules and a plurality of first crossbars extending at right angles between said first bars; and wherein said second anchor comprises a pair of parallel second bars each engaging at least part of the second grooves of adjacent panels of adjacent modules and a plurality of second crossbars extending at right angles between said second bars, and wherein said first crossbars of the first anchor comprise at least one opening adapted to receive at least one reinforcing bar; and wherein at least one of the modules is closed on at least one side by a head disposed in abutment against the panels and having a pair of C-shaped grooves communicating at their ends with respective first grooves of said panels, additionally comprising a third anchor adapted to connect the head to the panels and comprising a C-shaped bar engaging with at least part of the first groove and at least one of said pair of C-shaped grooves.

27. The building construction of claim 26, wherein at least one of the panels are joined at right angles and wherein the anchors comprise a pair of parallel L shaped bars.

28. A building construction comprising a plurality of prefabricated finishing modules, said finishing modules comprising:

at least one pair of panels facing one another, each such panel being bounded by first edges opposite one another and by second edges opposite one another and extending between respective ends of the first edges; wherein said first edges of each panel have respective first longitudinal grooves aligned with one another and said second edges have respective second longitudinal grooves aligned with one another and transversely offset with respect to the first grooves, said first and second grooves presenting respective end portions shaped so as to intersect the adjacent grooves; and first and second anchors, wherein said first and second anchors at least partially engage said first and second grooves, and intersect one another reciprocally for connecting the module to adjacent modules;

wherein at least one of the panels are joined at right angles and wherein the anchors comprise a pair of parallel L shaped bars.

* * * * *

UNITED STATES PATENT AND TRADEMARK OFFICE

CERTIFICATE OF CORRECTION

PATENT NO. : 6,474,033 B1 
DATED : November 5, 2002
INVENTOR(S) : Claudio Luchini and Giulio Vallacqua It is certified that error appears in the above-identified patent and that said Letters Patent is hereby corrected as shown below:

Title page,
Item [73], Assignees, please replace "Studio Arch. Claudio Luchini, Aosta (IT); Studio3GV - Progetti - Giulio, Aosta (IT); Vallacqua Ingegnere-Giacomo. Aosta (IT); Galvami Architto S.S., Aosta (IT)" with -- Studio Arch. Claudio Luchini, Aosta (IT); Studio 3GV - Progetti - Giulio Vallacqua Ingegnere - Giacomo Galvani Architetto S.S., Aosta (IT) --.

Signed and Sealed this

Twenty-second Day of July, 2003

JAMES E. ROGAN
*Director of the United States Patent and Trademark Office*